US010626342B2

(12) United States Patent
Vasudevan et al.

(10) Patent No.: US 10,626,342 B2
(45) Date of Patent: Apr. 21, 2020

(54) PROCESS FOR ENHANCING GASOLINE OCTANE BOOSTERS, GASOLINE BOOSTERS, AND GASOLINES

(71) Applicant: SABIC GLOBAL TECHNOLOGIES B.V, Bergen op Zoom (NL)

(72) Inventors: Vinodkumar Vasudevan, Kerala (IN); Guillermo Leal, Merida (VE); Somak Paul, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 9 days.

(21) Appl. No.: 15/777,996

(22) PCT Filed: Nov. 22, 2016

(86) PCT No.: PCT/IB2016/057044
§ 371 (c)(1),
(2) Date: May 22, 2018

(87) PCT Pub. No.: WO2017/089962
PCT Pub. Date: Jun. 1, 2017

(65) Prior Publication Data

US 2018/0346838 A1 Dec. 6, 2018

Related U.S. Application Data

(60) Provisional application No. 62/267,337, filed on Dec. 15, 2015, provisional application No. 62/258,650, filed on Nov. 23, 2015.

(51) Int. Cl.

| | |
|---|---|
| ***C10L 10/10*** | (2006.01) |
| ***C10L 1/02*** | (2006.01) |
| ***C10L 1/182*** | (2006.01) |
| ***C10L 1/185*** | (2006.01) |
| ***C10L 1/14*** | (2006.01) |
| ***C10L 1/18*** | (2006.01) |

(52) U.S. Cl.
CPC ..... *C10L 10/10* (2013.01); *C10L 1/023* (2013.01); *C10L 1/14* (2013.01); *C10L 1/1817* (2013.01); *C10L 1/1822* (2013.01); *C10L 1/1852* (2013.01); *C10L 1/1824* (2013.01); *C10L 2290/02* (2013.01); *C10L 2290/38* (2013.01)

(58) Field of Classification Search
CPC combination set(s) only.
See application file for complete search history.

(56) References Cited

U.S. PATENT DOCUMENTS

| | | | | |
|---|---|---|---|---|
| 2005/0167260 A1 | 8/2005 | Kong et al. | | |
| 2010/0258071 A1 | 10/2010 | Paggi et al. | | |
| 2012/0090226 A1* | 4/2012 | Lamoureaux | C10L 1/02 | 44/452 |
| 2015/0267130 A1* | 9/2015 | Butley | C10G 65/12 | 568/321 |
| 2016/0184791 A1* | 6/2016 | Appelbaum | C02F 1/34 | 204/157.3 |

FOREIGN PATENT DOCUMENTS

| | | |
|---|---|---|
| CN | 1127518 | 7/1996 |
| CN | 2455719 | 10/2001 |
| CN | 102603029 A | 7/2012 |
| EP | 0227176 A2 | 7/1987 |
| EP | 0541312 A1 | 5/1993 |
| EP | 0596611 B1 | 5/1994 |
| EP | 2774970 A1 | 9/2014 |
| FR | 2622893 A1 | 5/1989 |
| WO | 2013067097 A1 | 5/2013 |
| WO | 2013086138 A1 | 6/2013 |

OTHER PUBLICATIONS

International Search Report for International Application No. PCT/IB2016/057044, International filing date Nov. 22, 2016, dated Feb. 21, 2017, 5 pages.
Kong, et al., "Plasma Processing of Hydrocarbon", Electric Power, 2007, 12 pages.
Patino et al., "Oxidation of Cycloalkanes and Diesel Fuels by Means of Oxygen Low Pressure Plasmas", Energy & Fuels, 2002, 16, pp. 1470-1475.
Paulmier et al., "Use of non-thermal plasma for hydrocarbon reforming", Chemical Engineering Journal 106, 2005, pp. 59-71.
Prieto et al., "Heavy oil conversion by plasma chemical reactors", Industry Applications Conference 1999, pp. 1144-1149, vol. 2, Abstract only, 2 pages.
Prieto, et al., "Nontherrnal plasma reactors for the production of light hydrocarbon olefins from heavy oil", Brazilian Journal of Chemical Engineering, vol. 20, No. 1, Jan./Mar. 2003, 7 pages.
Written Opinion for International Application No. PCT/IB2016/057044, International Filing Date Nov. 22, 2016, dated Feb. 21, 2017, 6 pages.
Office Action issued in corresponding Chinese Patent Application No. 201680067952.2, dated Sep. 29, 2019.

* cited by examiner

*Primary Examiner* — Ellen M McAvoy
*Assistant Examiner* — Chantel L Graham
(74) *Attorney, Agent, or Firm* — Norton Rose Fulbright US LLP

(57) ABSTRACT

A process for preparing a gasoline octane boosting composition, including contacting a pyrolysis oil with a non-thermal oxygen plasma to produce an oxidized pyrolysis oil; and mixing the oxidized pyrolysis oil with a gasoline additive to produce the gasoline octane boosting composition. The gasoline octane boosting composition can be used in a gasoline blend.

15 Claims, No Drawings

PROCESS FOR ENHANCING GASOLINE OCTANE BOOSTERS, GASOLINE BOOSTERS, AND GASOLINES

CROSS REFERENCE TO RELATED APPLICATIONS

This application is a National Stage application of PCT/IB2016/057044, filed Nov. 22, 2016, which claims the benefit of U.S. Provisional Application No. 62/267,337, filed Dec. 15, 2015, and U.S. Provisional Application No. 62/258,650, filed Nov. 23, 2015, all of which are incorporated by reference in their entirety herein.

BACKGROUND

This disclosure is directed to a process for improving octane boosters for gasoline, the improved boosters, and gasolines containing the boosters.

Commercial gasoline, which is fuel for internal combustion engines, is a refined petroleum product that is typically a mixture of hydrocarbons (base gasoline), additives, and blending agents. Additives and blending agents are added to the base gasoline to enhance the performance and the stability of gasoline, and can include anti-knock agents, anti-oxidants, metal deactivators, lead scavengers, anti-rust agents, anti-icing agents, upper-cylinder lubricants, detergents, and dyes.

When used in high compression internal combustion engines, gasoline has the tendency to "knock." Knocking occurs when combustion of the air/fuel mixture in the cylinder does not start off correctly in response to ignition because one or more pockets of air/fuel mixture pre-ignite outside the envelope of the normal combustion front. Anti-knocking agents, also known as octane boosters, reduce the engine knocking phenomenon, and increase the octane rating of the gasoline. Prior octane boosters such as tetraethyl lead and methylcyclopentadienyl manganese tricarbonyl (MMT) have been or are being phased out for environmental, health, or other reasons.

Preferred compounds in present use for formulating octane boosters include $C_4$ oxygenate compounds such as methyl tert-butyl ether (MTBE), ethyl tert-butyl ether (ETBE), and n-butanol and its isomers. However, the production and storage of the large quantities of these materials at oil refineries can be costly. In addition, limitations on the use of high concentrations of additives by regulatory mandate increase the difficulty and expense of refining operations that produce high-octane fuels.

In view of the foregoing, there remains a need to provide cost-effective methods for producing octane-boosting compositions, including processes for modifying or improving the properties of existing octane boosters and compositions that are made by the processes.

BRIEF DESCRIPTION

Described herein is a process for preparing an octane boosting composition for gasoline. The process comprises contacting a pyrolysis oil with a non-thermal oxygen plasma to produce an oxidized pyrolysis oil; and combining the oxidized pyrolysis oil with a gasoline additive to produce the gasoline octane boosting composition.

Also described herein is a gasoline octane boosting composition comprising the oxidized pyrolysis oil and the gasoline additive. Also described herein is a gasoline blend comprising 85 to 99 vol % of a fuel-grade base gasoline and 1 to 15 vol % of the gasoline octane boosting composition.

The above described and other features are exemplified by the following figures and detailed description.

DETAILED DESCRIPTION

Described herein is a process and composition for improving the quality and octane boosting properties of octane boosting compositions. It has been found by the inventors that the quality of pyrolysis oil can be significantly improved by treatment with plasma technology, specifically a low-temperature, non-thermal plasma (NTP), also known as non-equilibrium plasma (NEP). The NTP treatment oxidizes the constituents of the pyrolysis oil to produce alcohols, diols, polyols, or carbonyl compounds such as aldehydes and ketones, leading to an overall increase of the oxygen content of the pyrolysis oil. Pyrolysis oils subjected to the non-thermal plasma treatment can further have improved physical and chemical properties such as color, odor, volatility, density, and chemical composition. The treated oils can then be used as a component of octane boosting compositions.

Among the advantages of using non-thermal plasma for the treatment of pyrolysis oil are low temperature, low energy consumption, and lower electrode erosion, since the cooling of the electrodes is generally not necessary. Without being bound by theory, it is believed that the low energy consumption of the non-thermal plasma treatment is made possible by the exothermicity of the oxidation of the pyrolysis oils. The heat released by the exothermic oxidation reaction generates excited $O(^3P)$ atoms, which perform the oxidation.

The NTP oxidation of pyrolysis oil described herein differs from combustion and conventional plasma-mediated hydrocarbon reforming processes such as plasma partial oxidation. Plasma partial oxidation of hydrocarbons occurs when a sub-stoichiometric amount of oxygen is supplied to partially oxidize a feedstock fuel such as methane. Partial oxidation is an exothermic reaction where the amount of heat released is considerably less than the heat release caused during complete combustion. The primary products of plasma partial oxidation are hydrogen and carbon monoxide (also known as synthesis gas or syngas), and the primary products of full combustion are water and carbon monoxide. In contrast, the NTP oxidation of pyrolysis oil is neither a combustion nor a partial combustion process. The NTP oxidation of pyrolysis oil instead utilizes an $O(^3P)$ rich oxygen plasma to individually oxidize hydrocarbon components of the pyrolysis oil into alcohols, diols, polyols, and other carbonyl compounds. The process produces no hydrogen or carbon monoxide (partial oxidation products) or water and carbon dioxide (combustion products).

A further advantage is that plasma-generated $O(^3P)$ species are highly reactive and can participate in chain reactions that promote or accelerate reaction pathways. As a result, the NTP oxidation process requires no additional metallic catalyst. Hence, the complications commonly associated with metal-catalyzed oxidation systems are avoided. For example, traditional thermal catalytic systems require long preheating times in order to reach the activation temperatures required for the metal catalysts. These temperatures are in the range of 900-1,300 K, and in view of the typical high density of packed-bed and monolith-structured catalyst systems, preheating times can be on the order of tens of minutes to hours. In the NTP oxidation process, the response is nearly instantaneous and requires no preheating to initiate the oxidation reactions. The NTP oxidation process and system also does not suffer from catalyst deactivation by sulfur and other contaminants in hydrocarbons. In addition, since the plasma generated is strongly oxidative, any soot precursors that form can be quickly oxidized, resulting in little or no soot formation.

As used herein, the terms "non-thermal plasma" and "non-equilibrium plasma" refer to any plasma having components, as opposed to thermal plasma or hot plasma, that are not in thermodynamic equilibrium, with the electrons often having higher temperatures than the other plasma components (i.e., up to 5,000 K, preferably 3,500-5,000 K, 2,500-3,500 K, more preferably 1.000-2,500 K). The background gas molecules in non-thermal plasma do not change, and are often comparable to or only slightly higher temperature than the ambient temperature at 28-50° C., preferably 28-40° C., more preferably 28-35° C. such that the plasma can be generated continuously for hours without any active cooling system.

Pyrolysis oil, sometimes also called pyrolysis fuel oil (PFO), pyrolysis gasoline, or Pygas, is a mixture of hydrocarbon compounds in $C_5$-$C_{10}$ or $C_5$-$C_{12}$ boiling range (naphtha range). It can be produced from byproducts (for example $C_9$ or higher fractions of catalytic reforming and steam cracking for ethylene/propylene production) of processes such as catalytic reforming, steam cracking or pyrolysis for ethylene/propylene production. Alternatively, pyrolysis oil can be a synthetic, liquid, non-fossil fuel product, produced by the pyrolysis (i.e., thermal decomposition and destructive distillation) of biomass, which is biological material derived from living or recently living organisms. When derived from a biomass, pyrolysis oil is also known as biomass pyrolysis oil, bio-oil, biocrude, biocrude oil, bioleum, wood pyrolysis oil, wood oil, liquid wood, biomass pyrolysis liquid, or pyroligeneous tar. Pyrolysis oil derived from a biomass source can contain oxygen at levels which are too high for it to qualify as a hydrocarbon. Pyrolysis oil can also be obtained from non-biomass source through non-biomass substrates such as rubber tires, thermoplastics (including post-consumer plastics) and auto fluff. Pyrolysis oil that is derived from non-biomass sources can contain more contaminants, such as sulfur, and can have a higher BTU content than biomass pyrolysis oil.

Pyrolysis oil comprises predominately aromatic compounds. The exact characteristics and composition of the pyrolysis oil can vary depending on the method of pyrolysis performed and the nature of the feedstock. In certain embodiments, the pyrolysis oil can be categorized as heavy pyrolysis oil (HPO) and light pyrolysis oil (LPO) based on physical characteristics such as liquid color and density. For example, HPO can be a dark brown liquid, while LPO is a blue green liquid. HPO has a slightly higher density, is typically 0.98 to 1 kilogram per liter (kg/L), while the density of LPO can be 0.95-0.96 kg/L.

Further, HPO and LPO are categorized as such based on their hydrocarbon composition. Both HPO and LPO contain no more than 0.5 weight percent (wt. %) of aliphatic hydrocarbons and these aliphatic hydrocarbons have five or more carbon atoms, for example 2-methylpentene. Apart from the small amount of aliphatic hydrocarbons, HPO and LPO each contains olefins, polyaromatic hydrocarbons (PAHs), naphthenes and naphthalenes. Other hydrocarbons that can be present include, but are not limited to, methylcyclopentene, benzene, 1,3-cyclohexadiene, dimethyl-1,3-cyclopentadiene, toluene, ethylbenzene, m-xylene, o-xylene, p-xylene, phenylacetylene, styrene, ethyltoluene, allylbenzene, n-propylbenzene, α-methylstyrene, propenylbenzene, vinyltoluene, dicyclopentadiene, indane, 1H-indene, tricyclodecene, bicyclododecene, dihydrodicyclopentadiene, phenylbutene, methyldicyclopentadiene, tricycloundecene, tetrahydrodicyclopentadiene, methyl-tricyclodecene, methylindene, dihydronaphthalene, dimethyldicyclopentadiene, methyltricycloundecene, naphthalene, ethyltricyclodecene, dimethylnaphthalene, biphenyl, 2-phenylnorbornene, biphenylene, acenaphthene, fluorene, phenanthrene, phenylnapthalene, terphenyl, and isomers thereof. Compared to LPO, HPO has a significantly higher content of benzene, toluene, ethylbenzene, and biphenyl of at least 25 wt. % based on the weight of the hydrocarbon (HPO or LPO), more specifically at least 30 wt. %, at least 40 wt. % or at least 45 wt. %.

While any pyrolysis oil can be used, the NTP oxidation described herein is especially suitable for HPO and LPO.

The pyrolysis oil is treated with an non-thermal oxygen plasma composed of predominantly $O(^3P)$ atoms (also referred to as "excited oxygen atoms") as the reactive oxygen species. The oxygen plasma is generated at pressure values of 0.1 to 1 millibar (mbar). Within this range the pressure can have a value of 0.1 to 0.133 mbar, 0.133 to 0.533 mbar, or 0.533 to 1 mbar. The oxygen plasma is generated at voltage of 0.5 to 10 kiloVolts (kV). Within this range the voltage can be 0.5 to 1 kV, 1 to 7 kV, or 7 to 10 kV. The reactions were carried out at a temperature where the vapor pressure of the pyrolysis oil was 20 to 100 times lower than the oxygen pressure.

A low electrical power is used to generate the non-thermal oxygen plasma. The oxygen plasma is generated using a power of 20 to 1000 Watts/gram of pyrolysis oil (W/g). Within this range the power can have a value of 1000 to 500 W/g, 500 to 250 W/g, 250 to 100 W/g, 20-85 W/g, or 35-70 W/g.

The reactive oxygen species comprises $O(^3P)$ atoms. Other reactive oxygen species that can be present in the plasma include, for example, hydroxyl radical (.OH), singlet oxygen ($^1O_2$), superoxide anion ($.O_2$) and triatomic oxygen or ozone ($O_3$). These radicals or species can be detected and quantified using a spectroscopic technique such as electron spin resonance (ESR) or electron paramagnetic resonance (EPR).

The non-thermal oxygen plasma has a degree of ionization from partially oxidized (1-99%, preferably 5-85%, more preferably 10-75%, even more preferably 15-60%) to fully oxidized (>99%, e.g. 99.1-99.3%, 99.4-99.5%, 99.6% and above). The degree of ionization. α, is defined using the formula below:

$$\alpha = \frac{n_i}{n_i + n_n} \quad \text{(Equation 1)}$$

where $n_i$ is the number density of ions and n is the number density of neutral atoms.

The non-thermal oxygen plasma can be generated using one or more plasma source or electric discharge platforms, including but not limited to direct-current or alternating-current gliding arc, gliding alternating-current, gliding radio frequency, pulsed or non-pulsed microwave, pulsed or non-pulsed corona discharge, dielectric barrier discharge, plasma pencil, plasma needle, plasma jet, pulsed, pulsed glow, pulsed double-pointed, spark, pulsed electron beam, and streamer. The generated plasma is sustained at a radio frequency (RF) that can range from medium frequency (MF, 300 kHz to 3 MHz), high frequency (HF, 3 to 30 MHz) to microwave frequency bands that encompass very high frequency (VHF, 30 to 300 MHz), ultrahigh frequency (UHF. 300 MHz to 3 GHz), super high frequency (SHF, 3 to 30 GHz) and extremely high frequency (EHF, 30 to 300 GHz).

Different levels of oxidation of the pyrolysis oil can be accomplished by controlling the plasma treatment duration. With very short treatment times, for example 30 seconds to 1 minute, 1 to 1.5 minutes, 1.5 to 2 minutes, or 1 to 2 minutes, less than 10 mole percent (mol. %) of the hydrocarbons in the pyrolysis oil is oxidized, for example, 5 to 10 mol. %, 2.5 to 5 mol. %, 1 to 2.5 mol. %. Major components formed are primary alcohols, diols, and polyols are produced by these short oxidation processes.

When the pyrolysis oil is subjected to longer treatment durations of up to 5 minutes, for example 2 to 5 minutes, 3 to 5 minutes and 4 to 5 minutes, about 20 mole percent (mol. %) of the hydrocarbons in the pyrolysis oil is oxidized, for example, 10 to 20 mol. %, 10 to 15 mol. %, or 15 to 20 mol. %. The oxidation products still consist essentially of primary alcohols, diols, and polyols.

At plasma treatment times of 5 to 10 minutes, other oxidation products such as secondary alcohols, aldehydes and ketones begin to form. Secondary alcohols are produced by oxidation of olefins and cycloalkenes. About 25 mol. % of the hydrocarbons in the pyrolysis oil are oxidized into about 22 to 24 mol. % alcohols (primary and secondary), 0.3 to 1.5 mol. % diols, 0.1 to 0.7 mol. % polyols, 0.1 to 0.5 mol. % aldehydes, and 0.1 to 0.8 mol. % ketones. Aldehydes and ketones are formed by progressive oxidation of primary and secondary alcohols that have been initially formed, respectively.

The pyrolysis oil can be subjected to even longer exposure times of 10 to 30 minutes to the non-thermal oxygen plasma, for example, 10 to 15 minutes, 15 to 20, or 20 to 30 minutes. The amount of the hydrocarbons in the pyrolysis oil oxidized/converted does not appear to increase much further than the 5 to 10 minutes treatment times and remains about 25 mol. %. However, the composition of the oxidation products can have a higher content of diols, polyols, aldehydes, and ketones. For example, the 25 mol. % pyrolysis oil hydrocarbons can be converted into 20 to 22 mol. % alcohols, 0.7 to 3.5 mol. % diols, 0.4 to 1.5 mol. polyols, 0.2 to 1.2 mol. % aldehydes, and 0.5 to 2 mol. % ketones.

Plasma exposure times exceeding 30 minutes are avoided as they can result in aldehydes and ketones being further oxidized into carboxylic acids or salts thereof, which can adversely affect the octane rating of gasolines.

The plasma treatment process can be implemented in a non-thermal plasma reactor designed for treating substrates or samples in liquid phases. The plasma reactor system comprises at least the following components in fluid communication with one another: a reaction vessel where a pyrolysis oil is placed; a reservoir containing pure oxygen gas; first and second electrodes; and a vacuum pump for inducing partial vacuum or low pressure to the system. The reaction vessel is further connected to an RF source generator. The reaction vessel and electrodes are generally cylindrical in shape but are not so limited. Oxygen can be introduced into the reaction vessel through one of the electrodes, which is hollow. The electrodes are electrically connected to a DC or AC power supply. One of the electrodes can be movable so as to manipulate the gap distance between the electrodes and thus the voltage at which the oxygen plasma is generated. The electrode gap can vary from millimeters to tens of millimeters and to several centimeters. A flow meter can be placed between the oxygen gas reservoir and the hollow electrode so as to set the plasma-forming flow rate at 0.0001 to 2.0 cubic meters per hour at standard temperature and pressure ($m^3$STP/h), preferably 0.1 to 1.5 $m^3$STP/h, more preferably 0.5 to 1.2 $m^3$STP/h. A pressure meter can be connected to the vacuum line to measure and monitor the system pressure. One or more traps can also be added to the vacuum line, downstream of the reaction vessel to collect any possible volatile product and to protect the vacuum pump. To ensure an even distribution of $O(^3P)$ atoms, the pyrolysis sample in the reaction vessel can be magnetically stirred. The reaction vessel volume can range from 100 milliliters (mL) to 5 liters (L).

When larger volumes (greater than 5 L) of pyrolysis oil are being treated, the reaction vessel can be further connected to a reservoir containing untreated pyrolysis oil. One or more inlets are disposed on one side of the vessel wall which defines the shape of the reaction vessel, allowing entry of the pyrolysis oil. Similarly, one or more outlets are disposed on the opposite side of the vessel wall to allow exit of the oxidized pyrolysis oil. A second flow meter can be installed to the plasma reactor system to regulate the sample flow rate and treatment time.

As stated above, NTP treatment oxidizes the pyrolysis oil so that the cyclic hydrocarbons, aromatics (including polyaromatics), naphthenes, and naphthalenes contained in the pyrolysis oil or a portion thereof can be individually oxidized to corresponding alcohol, diols, polyols, or carbonyl compounds such as aldehydes and ketones. Through the oxidation, the chemical composition of the pyrolysis is altered, leading to an overall increase of the oxygen content of the pyrolysis oil and improvement in other physical properties. In an embodiment, NTP treatment can result in an increase in at least one blending octane value (i.e., RON or MON), increase in volatility (distillation profile), lightening of liquid color (e.g., to less brown or yellow to nearly colorless), decrease in odor, or decrease in density.

Blending octane value (BOV) can be used to characterize the octane value of octane boosting gasoline additives oxygenates. The BOV is calculated from the difference between the octane value of a base gasoline with a known amount of the gasoline additive (i.e., the gasoline blend) and the base gasoline without the gasoline additive. The formula for BOV calculation is given below:

$$BOV = \frac{ON - ON_{base}(1 - x)}{x} = ON_{base} + \frac{ON - ON_{base}}{x} \quad \text{(Equation 2)}$$

where

ON=RON or MON of gasoline blended with an octane boosting additive $ON_{base}$=RON or MON of base gasoline without additive x=Volume fraction of the octane boosting compound RON (research octane number) can be determined according to DIN EN ISO 5164 (ASTM D 2699) and describes the knocking behavior at a low engine load and low rotational speeds. MON (motor octane number) can be determined according to DIN EN ISO 5163 (ASTM D 2700) and describes the behavior at a high engine load and under high thermal stress.

In some embodiments, the untreated pyrolysis oil can have a blending research octane value (BOV based on RON) of 93-96. The oxidized pyrolysis oil can have a blending research octane value of to up to 120, for example, 97-105 or 107-120, depending on the conditions of the treatment (i.e., duration, temperature, voltage, pressure, plasma flow rate, and the like). Preferably, the oxidized pyrolysis oil has a blending research octane value of greater than 100, for example 100 to 120. In some embodiments the improvement in blending research octane value can be 1 to 10%, or 5 to 22%, over the original value. In some embodiments, the oxidized pyrolysis oil can have an improvement in blending motor octane value (BOV based on MON) of 1 to 25%, or 1 to 20%, or 2 to 15% over the original value of the pyrolysis oil before NTP treatment.

Depending on the composition, the volatility of untreated pyrolysis oil, measured as Reid vapor pressure (RVP, i.e., vapor pressure at 100° F. (37.8° C.)), is highly variable but generally lower than the RVP of gasoline, and is in the range of 0.001 to 5.5 pounds per square inch (psi). To decrease the RVP and increase the blending compatibility of pyrolysis oil with base gasoline, a plasma treatment that produces more alcohol can be used as gasoline blend. Alcohols are generally less volatile and therefore a higher content of these compounds can effectively decrease the RVP of the oxidized pyrolysis oil. Moreover, a higher content of alcohol can induce the azeotropic or non-ideal blending effects of on the vapor pressure of gasoline. In some embodiments, the oxidized pyrolysis oil has an RVP of 3.0 to 6.0 psi. Within this range, the oxidized pyrolysis oil can have an RVP of 3.5 to 5.5 psi, or 4.0 to 5.0 psi.

The Saybolt color scale is used for grading light colored petroleum products including aviation fuels, kerosene, naphthas, white mineral oils, hydrocarbon solvents, and the like. ASTM D156 describes a standard test method for Saybolt color of petroleum products. A Saybolt number of +30 indicates that the product has no color or is completely clear, while the strongest evaluable Saybolt coloration value (the darkest) is −16. The untreated pyrolysis oil can have a dark to light brown color with a Saybolt value of +4 to +10. The NPT treatment can provide an oxidized pyrolysis oil product having a Saybolt number of at least +5. In some embodiments the oxidized pyrolysis oil can have an improvement in Saybolt number at least 5 units, for example 5 to 10 units, or 5 to 15 units, or 5 to 20 units compared to the original Saybolt number of the pyrolysis oil before NTP treatment.

In some embodiments, the aromatic, gasoline-odor of untreated pyrolysis oil is eliminated by the plasma oxidation process.

In some embodiments, the oxidized pyrolysis oil can have a decrease in density of 1 to 5%, or 5 to 10%, or 10 to 20% over the original density of the pyrolysis oil before NTP treatment.

A process for preparing a gasoline octane boosting composition comprises combining the oxidized pyrolysis oil (o-PO) with a gasoline additive (GA) at an o-PO:GA volume ratio ranging from 1:199 to 1:3.

Gasoline additives are compounds or compositions containing more than one type of compound that are added to gasoline to improve the octane rating of the gasoline or act as corrosion inhibitors or lubricants. As used herein, gasoline additives refer primarily but not exclusively to oxygenates. The terms "fuel oxygenates," "gasoline oxygenates" and simply "oxygenates" refer to a class of gasoline additives that contain one or more oxygen atoms and are designed to improve the octane rating of gasoline increasing the oxygen content of the gasoline. Most oxygenates are either alcohols or ethers, for example methanol (MeOH), ethanol (EtOH), isopropyl alcohol (IPA), n-propyl alcohol (NPrOH), isobutanol (IBA), n-butanol (BuOH), sec-butyl alcohol (SBA), tert-butyl alcohol (TBA) or gasoline grade tert-butyl alcohol (GTBA), tert-amyl alcohol (TAA) or tert-pentanol, methyl tert-butyl ether (MTBE), ethyl tert-butyl ether (ETBE), tert-amyl methyl ether (TAME), tert-amyl ethyl ether (TAEE), tert-hexyl methyl ether (THEME) and diisopropyl ether (DIPE) or a combination comprising at least one of the foregoing. These oxygenates can be produced by any known and acceptable chemical and biological reactions that are known in the art, for example, chemical reaction between isobutylene and methanol or ethanol to produce MTBE or ETBE respectively, microbial fermentation of sugars to produce bio-ethanol, and the like. Production processes can further include purification, distillation, or dehydration steps to increase purity and to remove water.

In some embodiments the gasoline octane boosting composition comprises 0.25 to 25.0 vol. % of the oxidized pyrolysis oil described herein and 75 to 99.75 vol. % of a gasoline oxygenate comprising methanol (MeOH), ethanol (EtOH), isopropyl alcohol (IPA), n-propyl alcohol (NPrOH), isobutanol (IBA), n-butanol (BuOH), sec-butyl alcohol (SBA), tert-butyl alcohol (TBA) or gasoline grade tert butyl alcohol (GTBA), tert-amyl alcohol (TAA) or tert pentanol, methyl tert-butyl ether (MTBE), ethyl tert-butyl ether (ETBE), ten-amyl methyl ether (TAME), tert-amyl ethyl ether (TAEE), tert-hexyl methyl ether (THEME) and diisopropyl ether (DIPE), or a combination of two or more of the foregoing. Within this range the oxidized pyrolysis oil is present in an amount of 0.25 to 15 vol %, 1 to 10 vol %, or 10 to 15 vol %, with the balance of the gasoline octane boosting composition being the gasoline oxygenate.

In some embodiments, the gasoline oxygenate is MTBE. The MTBE compound has an oxygen content of about 18-18.5 wt. % by weight. Mixing the oxidized pyrolysis oil with MTBE according to volume percentages described above can produce a gasoline octane boosting composition having an oxygen content of 25 to 35 wt. %, 27 to 32 wt. %, or 28 to 30 wt. %.

The gasoline octane boosting composition can have a blending research octane value of 105 to 120 and a blending motor octane value of 95 to 105.

The gasoline octane boosting composition is blended with a gasoline to provide a gasoline blend. The gasoline blend can comprises 85 to 99 vol. % of a base gasoline and 1 to 15 vol. % of the gasoline octane boosting composition. Within these ranges the gasoline blend comprises 5 to 15 vol. %, 7 to 13 vol. %, 8 to 12 vol. %, or 9-11 vol. % of the gasoline octane boosting composition with the balance of the gasoline blend being the base gasoline.

The gasoline blend can have a RON of 2 to 8 or more units higher than the base gasoline. Within this range the RON is 2 to 4 units higher, or 4 to 6 units higher. The gasoline blend can have an MON of 1.5 to 6 units higher than the base gasoline. Within this range the MON is 1.5 to 3 units higher, or 3 to 6 units higher.

The gasoline blend can an RVP within ±0.5 to ±1 psi of the RVP of the base gasoline.

The methods and compositions are further illustrated by the following examples, which are not intended to limit the claims.

The methods and compositions are further set forth in the Embodiments below, which are not intended to limit the claims.

Embodiment 1

A process for preparing a gasoline octane boosting composition, the process comprising: contacting a pyrolysis oil with a non-thermal oxygen plasma to produce an oxidized pyrolysis oil; and combining the oxidized pyrolysis oil with a gasoline additive to produce the gasoline octane boosting composition.

Embodiment 2

The process according to Embodiment 1, further comprising generating the non-thermal oxygen plasma at 0.1 to 1 mbar, 0.5 to 10 kV, and 20 to 1000 W/g.

Embodiment 3

The process according to any of the preceding embodiments, wherein the contacting is carried out for 30 seconds to 5 minutes and the oxidized pyrolysis oil produced comprises unoxidized hydrocarbons and an oxidation product comprising a primary alcohol, a diol, a polyol, or a combination comprising at least one of the foregoing.

Embodiment 4

The process according to any of the preceding embodiments, wherein the contacting is carried out for 5 to 30 minutes and the oxidized pyrolysis oil comprises unoxidized hydrocarbons and an oxidation product comprising a primary alcohol, secondary alcohol, diol, polyol, aldehyde, ketone, or a combination comprising at least one of the foregoing.

Embodiment 5

The process according to any of the preceding embodiments, wherein the oxidized pyrolysis oil has a blending research octane value of greater than 100.

Embodiment 6

The process according to any of the preceding embodiments, wherein the oxidized pyrolysis oil has a Saybolt number of at least +5.

Embodiment 7

The process according to any of the preceding embodiments, wherein the oxidized pyrolysis oil has a Reid vapor pressure of 3 to 6 psi.

Embodiment 8

The process according to any of the preceding embodiments, wherein the oxidized pyrolysis oil has a density of 0.8 to 0.95 kg/L.

Embodiment 9

The process according to any of the preceding embodiments, wherein the oxidized pyrolysis oil is combined with the gasoline additive at an oxidized pyrolysis oil:gasoline additive volume ratio of 1:199 to 1:3.

Embodiment 10

The process according to any of the preceding embodiments, wherein the gasoline additive comprises methanol, ethanol, isopropyl alcohol, n-propyl alcohol, isobutanol, n-butanol, sec-butyl alcohol, tert-butyl alcohol, gasoline grade tert butyl alcohol, tert-amyl alcohol, methyl tert-butyl ether, ethyl tert-butyl ether, tert-amyl methyl ether, tert-amyl ethyl ether, tert-hexyl methyl ether, diisopropyl ether or a combination comprising at least one of the foregoing, preferably wherein the gasoline additive is methyl tert-butyl ether.

Embodiment 11

A gasoline octane boosting composition produced by the process of any of the preceding embodiments.

Embodiment 12

The gasoline octane boosting composition according to Embodiment 11, having a blending research octane value of 105 to 120 and a blending motor octane value of 95 to 105.

Embodiment 13

The gasoline octane boosting composition according to embodiment 11 or 12, wherein the composition, when added to a base gasoline up to a final volume percentage of 15 vol. %, changes the Reid vapor pressure of the base gasoline by ±0.5 to ±1 psi.

Embodiment 14

A gasoline blend comprising: 85 to 99 vol. % of a fuel-grade base gasoline; and 1 to 15 vol. % of the gasoline octane boosting composition according to any of claims 13 to 15.

Embodiment 15

The gasoline blend according to Embodiment 14, having an oxygen content of 4 to 10 wt. % based on the weight of the base gasoline.

The compositions, methods, and articles can alternatively comprise, consist of, or consist essentially of, any appropriate components or steps herein disclosed. The compositions, methods, and articles can additionally, or alternatively, be formulated so as to be devoid, or substantially free, of any steps, components, materials, ingredients, adjuvants, or species that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %." etc.). "Combinations" is inclusive of blends, mixtures, alloys, reaction products, and the like. The terms "first," "second," and the like, do not denote any order, quantity, or importance, but rather are used to denote one element from another. The terms "a" and "an" and "the" do not denote a limitation of quantity, and are to be construed to cover both the singular and the plural, unless otherwise indicated herein or clearly contradicted by context. "Or" means "and/or" unless clearly stated otherwise. Reference throughout the specification to "some embodiments." "an embodiment," and so forth, means that a particular element described in connection with the embodiment is included in at least one embodiment described herein, and may or may not be present in other embodiments. In addition, it is to be understood that the described elements may be combined in any suitable manner in the various embodiments.

Unless defined otherwise, technical and scientific terms have the same meaning as is commonly understood by one of skill in the art to which this application belongs. All cited patents, patent applications, and other references are incorporated herein by reference in their entirety. However, if a term in the present application contradicts or conflicts with a term in the incorporated reference, the term from the present application takes precedence over the conflicting term from the incorporated reference.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A process for preparing a gasoline octane boosting composition, the process comprising:

contacting a pyrolysis oil with a non-thermal oxygen plasma to produce an oxidized pyrolysis oil; and combining the oxidized pyrolysis oil with a gasoline additive to produce the gasoline octane boosting composition.

2. The process according to claim 1, further comprising generating the non-thermal oxygen plasma at 0.1 to 1 mbar, 0.5 to 10 kV, and 20 to 1000 W/g.

3. The process according to claim 1, wherein the contacting is carried out for 30 seconds to 5 minutes and the oxidized pyrolysis oil produced comprises unoxidized hydrocarbons and an oxidation product comprising a primary alcohol, a diol, a polyol, or a combination comprising at least one of the foregoing.

4. The process according to claim 1, wherein the contacting is carried out for 5 to 30 minutes and the oxidized pyrolysis oil comprises unoxidized hydrocarbons and an oxidation product comprising a primary alcohol, secondary alcohol, diol, polyol, aldehyde, ketone, or a combination comprising at least one of the foregoing.

5. The process according to claim 1, wherein the oxidized pyrolysis oil has a blending research octane value of greater than 100.

6. The process according to claim 1, wherein the oxidized pyrolysis oil has a Saybolt number of at least +5.

7. The process according to claim 1, wherein the oxidized pyrolysis oil has a Reid vapor pressure of 3 to 6 psi.

8. The process according to claim 1, wherein the oxidized pyrolysis oil has a density of 0.8 to 0.95 kg/L.

9. The process according to claim 1, wherein the oxidized pyrolysis oil is combined with the gasoline additive at an oxidized pyrolysis oil:gasoline additive volume ratio of 1:199 to 1:3.

10. The process according to claim 1, wherein the gasoline additive comprises methanol, ethanol, isopropyl alcohol, n-propyl alcohol, isobutanol, n-butanol, sec-butyl alcohol, tert-butyl alcohol, gasoline grade tert butyl alcohol, tert-amyl alcohol, methyl tert-butyl ether, ethyl tert-butyl ether, tert-amyl methyl ether, tert-amyl ethyl ether, tert-hexyl methyl ether, diisopropyl ether or a combination comprising at least one of the foregoing, preferably wherein the gasoline additive is methyl tert-butyl ether.

11. A gasoline octane boosting composition produced by the process of claim 1.

12. The gasoline octane boosting composition according to claim 11, having a blending research octane value of 105 to 120 and a blending motor octane value of 95 to 105.

13. The gasoline octane boosting composition according to claim 11, wherein the composition, when added to a base gasoline up to a final volume percentage of 15 vol. %, changes the Reid vapor pressure of the base gasoline by ±0.5 to ±1 psi.

14. A gasoline blend comprising:

85 to 99 vol. % of a fuel-grade base gasoline; and 1 to 15 vol. % of the gasoline octane boosting composition according to claim 13.

15. The gasoline blend according to claim 14, having an oxygen content of 4 to 10 wt. % based on the weight of the base gasoline.

* * * * *